US011146006B2

(12) United States Patent
Chen

(10) Patent No.: US 11,146,006 B2
(45) Date of Patent: Oct. 12, 2021

(54) HIGH-POWER BOARD-TO-BOARD FLOATING CONNECTOR

(71) Applicant: P-TWO INDUSTRIES INC., Taoyuan (TW)

(72) Inventor: Pi-Miao Chen, Taoyuan (TW)

(73) Assignee: P-TWO INDUSTRIES INC., Taoyuan (TW)

( * ) Notice: Subject to any disclaimer, the term of this patent is extended or adjusted under 35 U.S.C. 154(b) by 0 days.

(21) Appl. No.: 16/908,705

(22) Filed: Jun. 22, 2020

(65) Prior Publication Data

US 2021/0210883 A1 Jul. 8, 2021

(30) Foreign Application Priority Data

Jan. 3, 2020 (TW) ..... 109100387

(51) Int. Cl.

| | |
|---|---|
| ***H01R 12/91*** | (2011.01) |
| ***H01R 12/71*** | (2011.01) |
| ***H01R 13/631*** | (2006.01) |
| *H01R 12/70* | (2011.01) |
| *H01R 13/00* | (2006.01) |
| *H01R 13/11* | (2006.01) |
| *H01R 13/24* | (2006.01) |
| *H01R 13/14* | (2006.01) |

(52) U.S. Cl.

CPC ..... *H01R 12/91* (2013.01); *H01R 12/716* (2013.01); *H01R 13/6315* (2013.01); *H01R 12/70* (2013.01); *H01R 13/00* (2013.01); *H01R 13/11* (2013.01); *H01R 13/14* (2013.01); *H01R 13/24* (2013.01)

(58) Field of Classification Search

CPC ..... H01R 12/91; H01R 12/716; H01R 13/00; H01R 13/11; H01R 12/70; H01R 13/6315; H01R 13/24; H01R 13/14

USPC ..... 439/248

See application file for complete search history.

(56) References Cited

U.S. PATENT DOCUMENTS

2018/0138618 A1* 5/2018 Hasegawa ..... H01R 43/18

* cited by examiner

*Primary Examiner* — Travis S Chambers
*Assistant Examiner* — Justin M Kratt

(57) ABSTRACT

The present invention provides a high-power board-to-board floating connector that comprises a male header and a female socket. The male head comprises a first electrode, a first housing and a first insertion element. The female socket comprises a second electrode, a second housing, a floating member, and a second insertion element. The second housing combines with the floating member to form a connection part which can be slightly moved in one or more directions, so that the male head can be connected to the female socket in a permissible range, and then the first electrode is electrically connected to the second electrode.

10 Claims, 6 Drawing Sheets

HIGH-POWER BOARD-TO-BOARD FLOATING CONNECTOR

CROSS-REFERENCE TO RELATED APPLICATION

This application claims the benefit of Taiwan Patent Application No. 109100387, filed on Jan. 3, 2020, in the Taiwan Intellectual Property Office, the disclosure of which is entirely incorporated herein by reference.

BACKGROUND

1. Technical Field

The present invention relates to a connector, especially relates to a board to-board floating connector.

2. Description of the Related Art

In tradition, when a male header electrically connects to a female socket, precise alignment is required to smoothly and electrically connect the male header and the female socket.

However, in a limited installation environment, taking a car body as an example, due to the limited installation space in the car body, an installer can't easily install the male header with the female socket together. Consequently, the male header and the female socket might be damaged by the installer. One of the male header and the female socket is disposed in the car body in advanced so that it is hard for one to be replaced with another, resulting in trouble status. In addition, when the male header and the female socket are connected together in a high power environment, it causes a large amount of waste heat. Once the waste heat can't be removed in time, it will be accumulated in the male header and the female socket which may be damaged accordingly and even cause electrical line to be short. Obviously, this exists a safety problem for a required highly security environment such as car usage.

In view of the foregoing, the present invention provides a high-power board-to-board floating connecter for solving the defects of the prior arts.

SUMMARY

A first aspect of the present invention is to provide a high-power board-to-board floating connector, which has a male header and a female socket. With the floating structure, the male header and the female socket may be connected without a precise alignment.

According to a second aspect of the high-power board-to-board floating connector of the present invention, the heat is dissipated by the nearby perforations of the jacks. Therefore, the high-power board-to-board floating connector may be applied in a high-power or high electric current application.

According to a third aspect of the high-power board-to-board floating connector of the present invention, an S-shaped electrode is adapted to match with the floating structure for floating connection.

According to a fourth aspect of the high-power board-to-board floating connector of the present invention, with a binding part connecting to an insertion element, the male header and the female socket are fixed on a board.

In order to reach the above and other requirements, an embodiment of the present invention, a high-power board-to-board floating connector for connecting to a first board and a second board is provided. The high-power board-to-board floating connector comprises a male header and a female socket. The male header also comprises a first electrode, a first housing and a first insertion element. The first electrode has a first connecting end connecting to the first board and a first free end. The first housing comprises a first body, a first connection part and a first binding part. The first body has a first space inside, and the first space comprises a first jack for accommodating the first electrode. The first free end of the first electrode is exposed in the first space. The first connection part extends from the first body. The first binding part is disposed on two wings of the first body. The first insertion element combines with the first binding part so that the first housing is fixed on the first board. The female socket comprises a second electrode, a second housing, a floating element and a second insertion element. The second electrode has a second connecting end connecting to the second board and a second free end. The second housing comprises a second body and a second binding part. The second body has a second space inside, and the second space comprises a second jack for accommodating the second electrode. The second free end of the second electrode is exposed in the second space. The second binding part is disposed on two wings of the second body and protrudes from the second body to form a C-shaped opening. The floating member is for connecting the first connection part to let the first electrode electrically connect the second electrode. The floating member comprises a third body and a third binding part. The third body has a third space, and the third space comprises a third jack. The third jack is disposed corresponding to the second jack to accommodate the second free end of the second electrode. The third binding part is disposed on two wings of the third body and protrudes from the third body to combines with the C-shaped opening. The second insertion element combines with the second binding part for fixing the second housing on the second board so that the third binding part is limited in the C-shaped opening.

Compared with the prior arts, the high-power board-to-board floating connector above provides a floating structure in, for example, a female socket, so that a male header can be inserted into the female socket in a movable range, such as the same direction, a vertical direction, or a horizontal direction of insertion direction, to be applied to different application environments.

DETAILED DESCRIPTION

To fully understand the purpose, features, and efficacy of the present invention, by the following specific embodiments and in conjunction with the attached schematic, the present invention to do a detailed description, instructions as follows.

In this disclosure, the use of "one" or "a/an" is used to describe the units, elements, and components disclosed herein. This is for convenience and provides a general meaning for the scope of the present invention. Therefore, unless it is clearly referred shown, such a description should be understood to include one at least, the singular and plural number.

In the present invention, the terms "comprise", "include", "have", "contain," or any other similar terms intended to cover non-exclusive inclusions. For example, a component, structure, product, or device containing a plural element is not limited to such elements listed herein, but may include other elements that are not explicitly listed but are generally inherent in the component, structure, product, or device. In addition, unless clearly stated to the contrary, the term "or" refers to the omnibus "or" and does not refer to exclusive "or".

Figure 1:
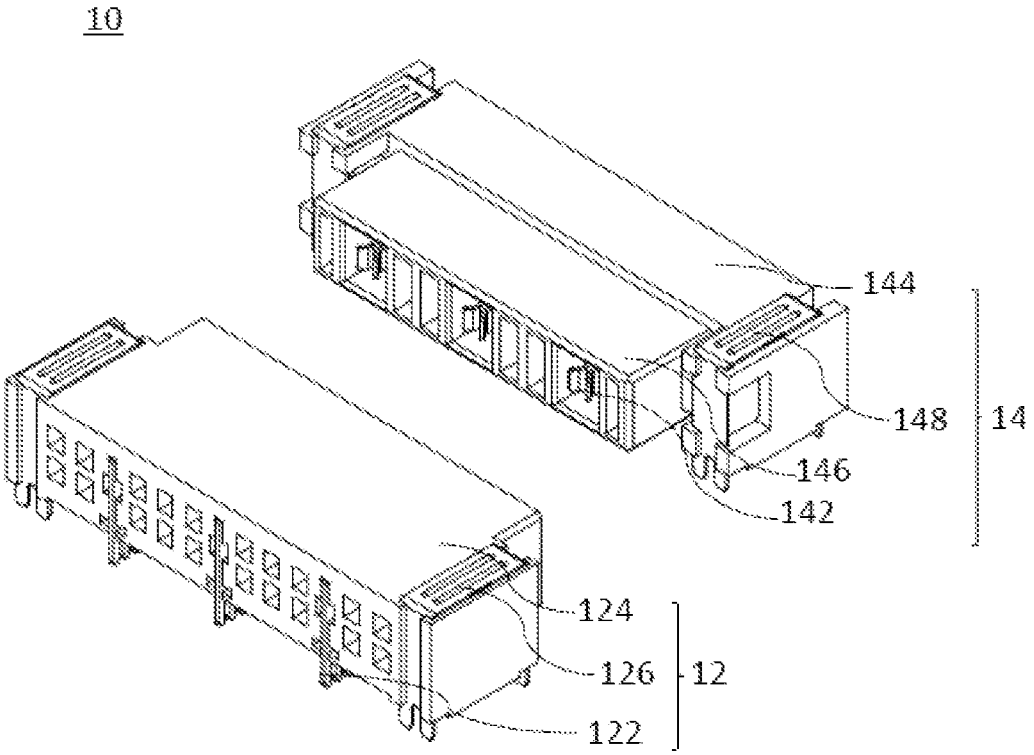
FIG. 1 is a three-dimensional view of the structure of a high-power board-to-plate floating connector in an embodiment of the present invention.

Please refer to FIG. 1, which is a three-dimensional view of the structure of a high-power board-to-board floating connector according to an embodiment of the present invention. In FIG. 1, a high-power board-to-board floating connector 10 connects to a first board and a second board. Although the first board and the second board are not shown in FIG. 1, but a person skilled in the art should understand that the first board and the second board may be a housing or circuit board having a circuit layout.

The high-power board-to-board floating connector 10 comprises a male header 12 and a female socket 14.

Figure 2:
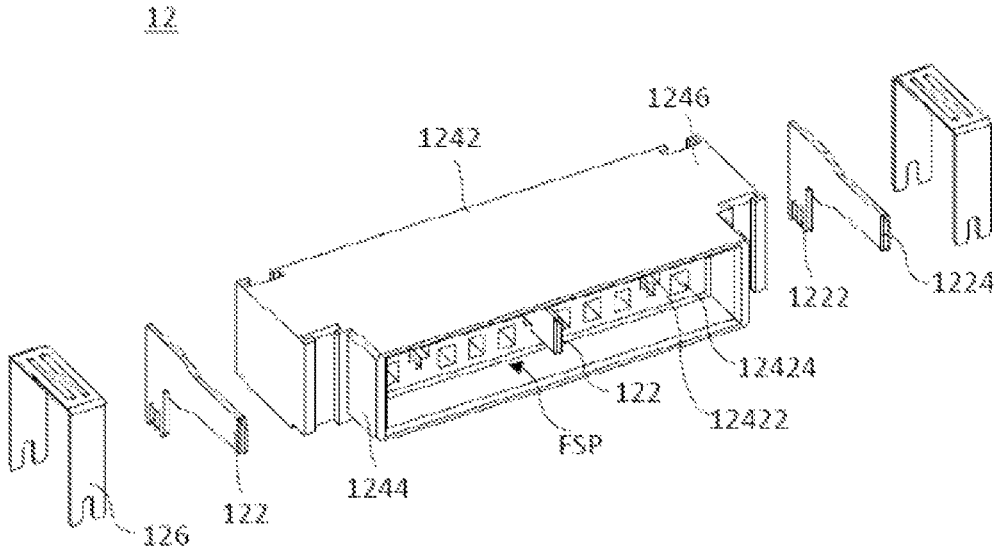
FIG. 2 is a detailed decomposition view of a male header of FIG. 1 of the present invention.

The male header 12 comprises a first electrode 122, a first housing 124 and a first insertion element 126. Please also refer to FIG. 2, which is a detailed decomposition view of the male header of FIG. 1.

The first electrode 122 has a first connecting end 1222 connecting to the first board and a first free end 1224. When the male header 12 is not connected to the female socket 14, which is dangled without connecting to any objects. In this embodiment, the number of the first electrodes 122 is three as an example. In other embodiments, the number of the first electrodes 122 may be one or more. Furthermore, the shape of the first electrode 122 is a sheet body, such as a L-shaped sheet body in this embodiment.

The first housing 124 is a rectangular body, which comprises a first body 1242, a first connection part 1244 and a first binding part 1246.

The first body 1242 has a first space FSP inside, and the first space FSP comprises a first jack 12422 for accommodating the first electrode 122. The first free end 1224 of the first electrode 122 is exposed in the first space FSP. In this embodiment, the first jack 12422 may be a perforated state, and the first electrode 122 is inserted in and placed in the first jack 12422 at assembling. In this embodiment, the number of the first jacks 12422 is three as an example. In other embodiments, the number of the first jacks 12422 may be one or more. In fact, the number of the first jacks 12422 is equal to or greater than the number of the first electrodes 122.

The first connection parts 1244 extends from the first body 1242, and the width of the first connection parts 1244 is smaller than the width of the first body 1242 for forming a T-shaped body. The first free end 1224 of the first electrode 122 is uncovered by the first connection part 1244.

The first binding parts 1246 are formed on two wings of the first body 1242 and extend from the first body 1242 outwards. Especially, the first binding parts 1246 each have C-shaped slots formed on two sides of the first binding part 1246 each for providing the guiding function. By designing the opening size of the C-shaped slots, the C-shaped slots may closely combine with the first insertion elements 126.

Figure 3:
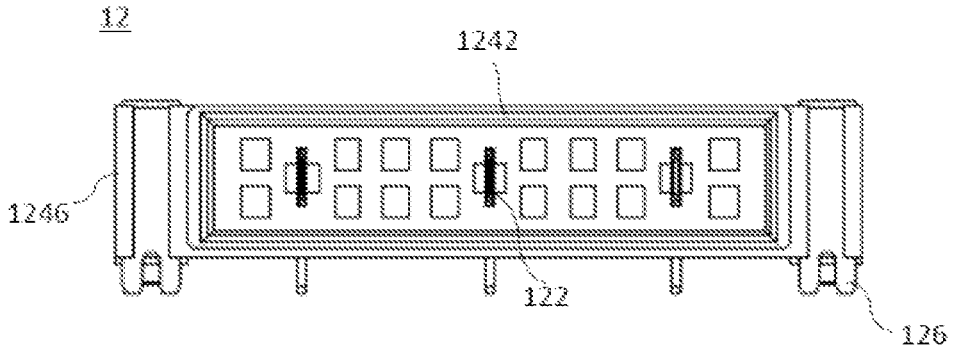
FIG. 3 is a combined front view of a male header of FIG. 2 of the present invention.

The first insertion elements 126 may be combined with the first binding parts 1246 for fixing the first board by the first housing 124. When the opening size of the C-shaped slot is designed to be the same as the thickness of the first insertion element 126, the first housing 124 may be steadily fixed on the first board. The first insertion element 126 is a C-shaped part. Please also refer to FIG. 3, which is a front view of the male header in FIG. 2.

It is worth noting that the first space FSP may comprise at least a first perforation 12424 not for accommodating the first electrodes 122. The first perforation 12424 is disposed on a side of the first jack 12422 or between a plurality of the first jacks 12422. Furthermore, the shape of the first perforation 12424 may be any shapes, here is a rectangular perforation as an example.

Figure 4:
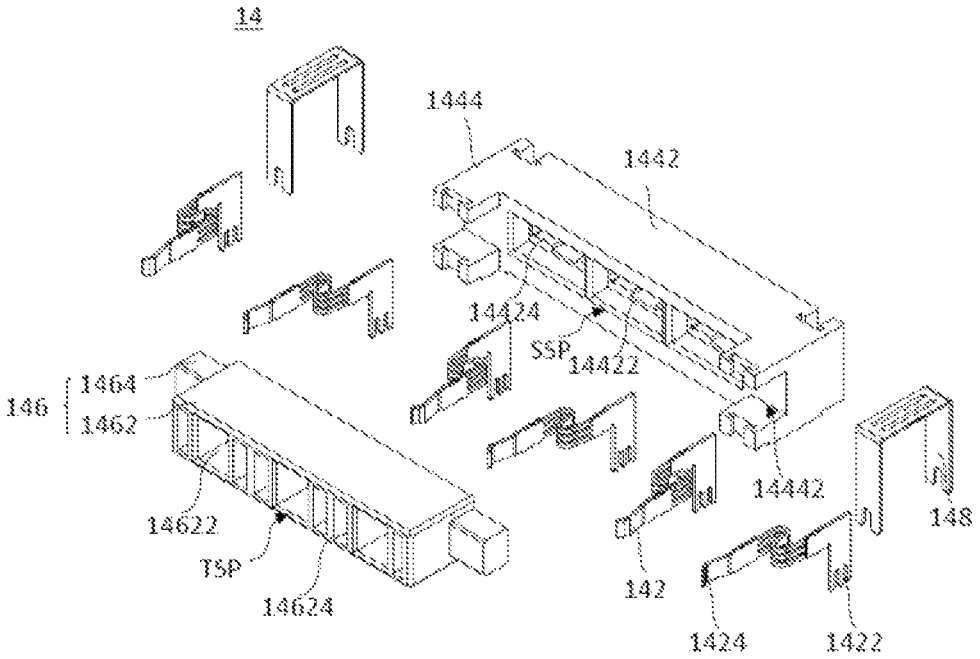
FIG. 4 is a detailed decomposition view of a male header of FIG. 1 of the present invention.

The female socket 14 further comprises a second electrode 142, a second housing 144, a floating member 146 and a second insertion element 148. Please also refer to FIG. 4, which shows the detailed exploded view of the female socket of FIG. 1.

The second electrode 142 has a second connecting end 1422 connecting to the second board and a second free end 1424. When the female socket 14 is not connected to the male header 12, the free end 1424 of the second electrode 142 is dangled without connecting to any objects. In this embodiment, the number of the second electrode 142 is six as an example. In other embodiments, the number of the second electrodes 142 may be more than one. Furthermore, the shape of the second connecting end 1422 of the second electrode 142 is a sheet body. The second free ends 1424 of the two second electrodes 142 can be used to form a Y-shape clamper for clamping the first electrode 122. It is worth noting that the second electrodes 142 each is bent in an S-shape for providing a displacement elasticity between the second connecting end 1422 and the second free end 1424 when connecting to the first electrode 122, such as toward left or right-, or toward front or back.

The second housing 144 is a rectangular body, which comprises a second body 1442 and a second binding part 1444.

The second body 1442 has a second space SSP inside, and the second space SSP comprises a second jack 14422 for accommodating the second electrode 142. The second free end 1424 of the second electrode 142 is exposed in the second space SSP. In this embodiment, the second jack 14422 may be a perforated state which causes the second electrode 142 to be inserted in and to be installed. In this embodiment, the number of the second jack 14422 is three as an example. In other embodiments, the number of the second jack 14422 may be one or more. In fact, the number of the second jacks 14422 is equal to or greater than the number of the second electrodes 142. In addition, the size of the second jacks 14422 is approximately larger than the size of the two second electrodes 142 for accommodating the two second electrodes 142, for example.

The second jack 14422 is inserted by the second electrode 142, and the second free end 1424 of the second electrode 142 is exposed in the second space SSP.

The second binding parts 1444 are formed on the two wings of the second body 1442 and protrudes from the second body 1442 to form the C-shaped openings 14442. In addition, the second binding parts 1444 also have the C-shaped slots for providing the guiding function. The opening size of the C-type slots is designed to let the C-shaped slots be closely combined with the second insertion elements 148.

The floating member 146 comprises a third body 1462 and a third binding part 1464. The floating member 146 is used to connect the first connection part 1244 to let the first electrode 122 electrically connect the second electrode 142.

Figure 5:
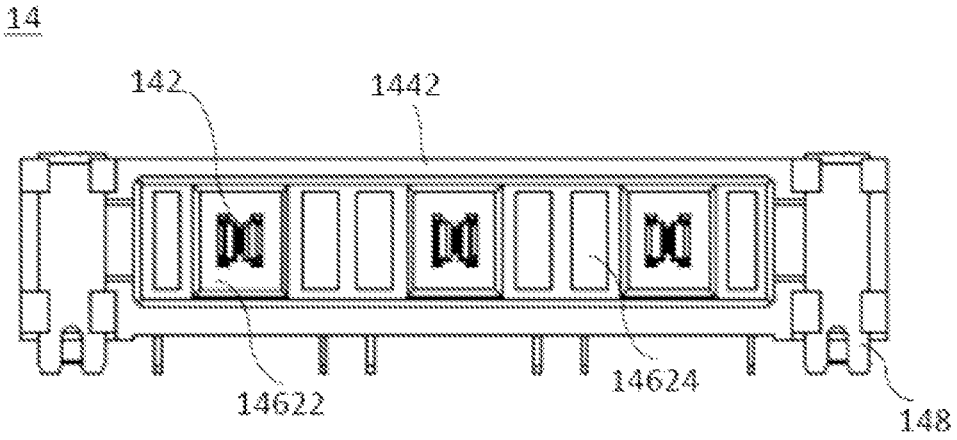
FIG. 5 is a composite front view of a male header of FIG. 4 of the present invention.

The third body 1462 has a third space TSP comprising a third jack 14622. The third jack 14622 is disposed corresponding to the second jack 14422 to accommodate the second free end 1424 of the second electrode 142. Furthermore, the third binding parts 1464 are disposed on two wings of the third body 1462 and protrudes from the third body 1462. Please refer to FIG. 5, which is a front-view of the assembled female socket in FIG. 4. In this embodiment, the third binding part 1464 is taken a lug as an example. There is a gap between the lug and an inner edge of the C-shaped opening 14442. When the third binding part 1464 is disposed in the C-shaped opening 14442, the lug can move forward, backward, left, and right in the C-shaped opening 14442.

Figure 6:
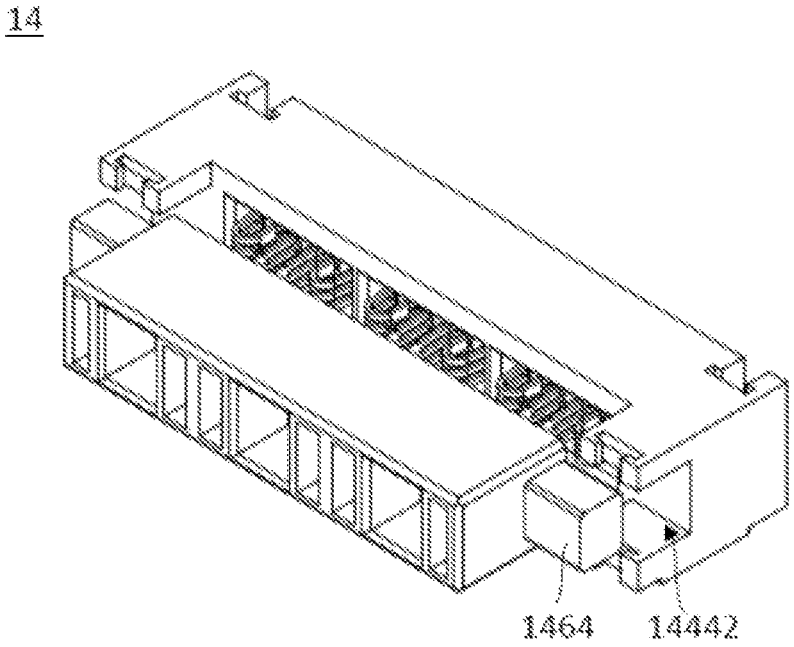
FIG. 6 is a composite schematic view of a male header of FIG. 4 of the present invention.

The second insertion element 148 combines with the second binding part 1444 for fixing the second board by the second housing 144 and limiting the third binding part 1464 in the C-shaped opening 14442. When the opening size of the C-shaped slot is designed to be the same as the thickness of the second insertion element 148, the second housing 144 may be steadily fixed on the second board. In this embodiment, the second insertion element 148 is C-shaped. Please refer to FIG. 6, which is a schematic view of the assembled female socket in FIG. 4.

By the first connection part 1244 connecting to the floating member 146, the first electrode 122 electrically connects to the second electrode 142.

It is worth noting that the second space SSP and the third space TSP can further comprise second perforations 14424 and third perforations 14624, respectively, for not accommodating the second electrodes 142. The second perforations 14424 may be disposed on a side of the second jack 14422 or between a plurality of the second jacks 14422, and the third perforations 14624 may be disposed on a side of the third jack 14622 or between a plurality of the third jacks 14622. Furthermore, the shape of the first perforations 12424 and the third perforations 14624 may be any shapes, such as a rectangular shape.

An embodiment of this invention has been disclosed above, but a person skilled in the art should understand that the embodiment is only used to depict the present invention, and not to be interpreted as limiting the scope of the present invention. It should be noted that any change or modifications should cover the scope of the present invention. Therefore, the scope of protection of the present invention shall be defined by the scope of the claims of the application.

What is claimed is:

1. A high-power board-to-board floating connector for connecting a first board and a second board, the high-power board-to-board floating connector comprising:

a male header comprising:

a first electrode having a first connecting end connecting to the first board and a first free end;

a first housing comprising:

a first body having a first space inside, wherein the first space comprises a first jack for accommodating the first electrode, and the first free end of the first electrode is exposed in the first space;

a first connection part extending from the first body; and a first binding part disposed on two wings of the first body; and a first insertion element combining with the first binding part for fixing the first board by the first housing;

a female socket comprising:

a second electrode having a second connecting end connecting to the second board and a second free end;

a second housing comprising:

a second body having a second space inside, wherein the second space comprises a second jack for accommodating the second electrode, and the second free end of the second electrode is exposed in the second space; and a second binding part disposed on two wings of the second body and protruding from the second body to form C-shaped opening;

a floating member for connecting the first connection part to let the first electrode electrically connect the second electrode, wherein the floating member comprises:

a third body having a third space inside, wherein the third space comprises a third jack disposed corresponding to the second jack to accommodate the second free end of the second electrode; and a third binding part disposed on two wings of the third body and protruding from the third body to combine with the C-shaped opening; and a second insertion element combining with the second binding part for fixing the second board by the second housing and limiting the third binding part in the C-shaped opening.

2. The high-power board-to-plate floating connector of claim 1, wherein the first binding part is formed as a C-shaped slot for inserting the first insertion element.

3. The high-power board-to-plate floating connector of claim 1, wherein the second binding part is formed as a C-shaped slot for inserting the second insertion element.

4. The high-power board-to-plate floating connector of claim 3, wherein the third binding part is a lug, and there is a gap between the lug and an inner edge of the C-shaped opening.

5. The high-power board-to-plate floating connector of claim 1, wherein the first space further has a perforation disposed on a side of the first jack.

6. The high-power board-to-plate floating connector of claim 1, wherein the second space further has a perforation disposed on a side of the second jack.

7. The high-power board-to-plate floating connector of claim 1, wherein the third space further has a perforation disposed on a side of the third jack.

8. The high-power board-to-plate floating connector of claim 1, wherein the second electrodes are bent as an S-shape between the second connecting end and the second free end for connecting the first electrode.

9. The high-power board-to-plate floating connector of claim 8, wherein the second electrode is a sheet body, and a plurality of the second electrodes are formed as a Y-shape clamper for clamping the first electrode.

10. The high-power board-to-plate floating connector of claim 1, wherein the first electrode is a sheet body.

* * * * *